US008250896B2

(12) United States Patent
Hirotani

(10) Patent No.: US 8,250,896 B2
(45) Date of Patent: Aug. 28, 2012

(54) PRESS-DIE AND PRESS-WORKING METHOD

(75) Inventor: Kaoru Hirotani, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 460 days.

(21) Appl. No.: 12/692,891

(22) Filed: Jan. 25, 2010

(65) Prior Publication Data

US 2010/0186475 A1 Jul. 29, 2010

(30) Foreign Application Priority Data

Jan. 26, 2009 (JP) ..... 2009-014434

(51) Int. Cl.
*B21D 24/04* (2006.01)
*B21D 11/02* (2006.01)

(52) U.S. Cl. ..... 72/350; 72/349; 72/313; 72/709; 72/361

(58) Field of Classification Search ..... 72/309, 72/313, 349, 350, 351, 356, 361, 379.2, 420, 72/709

See application file for complete search history.

(56) References Cited

U.S. PATENT DOCUMENTS

| | | | | |
|---|---|---|---|---|
| 2,294,451 | A * | 9/1942 | Ernst | 72/19.9 |
| 6,032,504 | A * | 3/2000 | Onat et al. | 72/297 |
| 6,085,571 | A * | 7/2000 | Brinas et al. | 72/420 |
| 6,354,131 | B1 * | 3/2002 | Pirchl | 72/351 |
| 6,668,612 | B2 * | 12/2003 | Kruger et al. | 72/420 |
| 7,536,892 | B2 * | 5/2009 | Amino et al. | 72/305 |
| 7,971,467 | B2 * | 7/2011 | Yamada | 72/356 |

FOREIGN PATENT DOCUMENTS

| | | |
|---|---|---|
| CA | 2666678 | 4/2008 |
| JP | 10-305331 | 11/1998 |
| JP | 2001-001064 | 1/2001 |

* cited by examiner

*Primary Examiner* — David B Jones
(74) *Attorney, Agent, or Firm* — Rankin, Hill & Clark LLP

(57) ABSTRACT

A movable die is provided to be displaceable in an upper die. When the upper die is moved downward to press a steel plate together with a lower die, only the movable die first abuts on the steel plate to carry out forming together with the lower die. Then, the upper die is further moved downward to form a part which has not been formed by the movable die.

3 Claims, 7 Drawing Sheets

PRESS-DIE AND PRESS-WORKING METHOD

BACKGROUND OF THE INVENTION

1. Field of the Invention

The present invention relates to a press-die and a press-working method, for example, for processing a plate material to be a body panel of an automobile or the like.

2. Background Art

Conventionally, when a body panel of a vehicle is formed from a steel plate, a peripheral edge portion of the steel plate is previously pressed by a blank holder, and a press-die is then moved forward and backward to carry out the press-working.

By a press-working apparatus having the press-die, a deep drawing shape such as a small round shape may be formed depending on a portion required for the body panel in some cases. However, there is a fear that a crack or a wrinkle might be generated when the deep drawing shape is formed from a thin steel plate.

In recent years, therefore, there has been known a press-working apparatus capable of avoiding a generation of the crack or the wrinkle.

As shown in FIGS. 7A and 7B, in a press-working apparatus 1, an upper die 3 is attached to an upper bolster 2 capable of enabling a stroke in a vertical direction. A lower die 5 is attached to a lower bolster 4 disposed below the upper bolster 2. The upper die 3 and the lower die 5 are disposed opposite to each other. Moreover, a forming aiding member 7 to be controlled in forward and backward movements by driving means 6 is provided in the upper die 3 and can independently carry out a stroke displacement with respect to the upper die 3. Furthermore, a static die 8 for performing forming together with the forming aiding member 7 is fixed to a side part of the lower die 5 which faces the forming aiding member 7. In addition, a blank holder 10 for holding a peripheral edge portion of a blank 9 is provided on a side of the static die 8.

As shown in FIG. 7A, in a preparing state in which the blank 9 taking a shape of a thin plate is mounted between the upper die 3 and the lower die 5 and the forming aiding member 7 is slightly protruded from a lower side of the upper die 3, the upper die 3 is moved downward to interpose the peripheral edge portion of the blank 9 between the upper die 3 and the blank holder 10. When the upper die 3 is further moved downward, the blank 9 is interposed between the forming aiding member 7 and the static die 8 so that a deep drawing shape is previously formed. Finally, a residual part in the blank 9 is formed by the upper die 3 and the lower die 5 as shown in FIG. 7B.

Thus, a product can be obtained (for example, see Patent Document 1).

Patent Document 1: JP-B2-3720216

In the prior art according to the Patent Document 1, however, in some cases in which the forming aiding member 7 comes in contact with the blank 9 earlier than the static die 8 to start a processing operation, a crack or a wrinkle is generated in the blank 9, for example. When the blank 9 is formed by the upper die 3 and the forming aiding member 7, moreover, there is a fear that a linear breakage might be generated in a portion to be a boundary between the upper die 3 and the forming aiding member 7 in the product.

SUMMARY OF THE INVENTION

One or more embodiments of the invention provide a press-die and a press-working method which can reliably obtain a press-product in a desirable shape, and furthermore, can enhance quality of the press-product still more.

In accordance with one or more embodiments of the invention, a press-die is provided with: an upper die configured to move in an axial direction under a driving action of a driving portion of the press-working apparatus; a movable die provided within the upper die and configured to relatively move with respect to the upper die; a lower die provided in an opposite position to the upper die and the movable die; and a holder provided in a side part of the lower die to face the upper die, configured to hold a peripheral edge portion of the plate material together with the upper die, and also configured to move in the axial direction under a pressing action through the upper die. The upper die and the movable die are configured to move downward together so that a first forming portion in the product is formed from the plate material by the movable die and the lower die and a second forming portion in the product is formed by the upper die and the lower die. The upper die and the holder are configured to continuously move downward together when the first forming portion is formed by the movable die.

According to the press-die of the above structure, the movable die is relatively movable with respect to the upper die, and the upper die is moved downward together with the movable die so that the first forming portion in the product is formed by the movable die and the second forming portion is formed between the upper die and the lower die. In addition, the upper die continuously moves downward together with the holder so as to press the peripheral edge portion of the plate material. Therefore, a tensile force is always applied to the plate material. Consequently, it is possible to reliably and easily reach a plastic region when the plate material is processed by the movable die and the upper die. As a result, it is possible to process the plate material by performing a plastic deformation into a desirable shape without generating a crack or a wrinkle in the plate material. Thus, it is possible to obtain a product of high quality.

Moreover, in accordance with one or more embodiments of the invention, a press-working method is provided with: moving an upper die downward in an axial direction under a driving action of a driving portion of the press-working apparatus; holding a peripheral edge portion of the plate material between the upper die and a holder facing the upper die, and moving the peripheral edge portion downward together with the holder; causing the plate material to abut on a lower die, thereby carrying out pre-forming; press-working a part of the plate material by a movable die which moves with the upper die; and further moving the upper die toward the lower die side, thereby press-working an unformed part in the plate material by the upper die and the lower die. The upper die and the holder are continuously moved downward during said press-working by the movable die.

According to the method of the above, in the state in which the peripheral edge portion of the plate material is held between the upper die and the holder, the peripheral edge portion is pressed downward, the plate material is caused to abut or the lower die to carry out pre-forming, the first forming portion in the product is then previously formed by the movable die, and the second forming portion is formed between the upper die which is moved downward and the lower die so that a product is obtained. In addition, the upper die and the holder are continuously moved downward during the processing operation carried out by the movable die. Therefore, a tensile force is applied to the plate material so that it is possible to carry out the processing operation through the movable die and the upper die in order. Moreover, by carrying out the processing operation through the movable die prior to the processing operation through the upper die, it is possible to obtain a product of high quality without generating a crack or a wrinkle in the plate material.

Further, a boundary portion of the plate material which corresponds to a boundary between the movable die and the upper die and a vicinity of the boundary portion facing the movable die and the upper die may be caused to abut on the lower die before the processing operation is carried out by the movable die. Consequently, it is possible to avoid an occurrence of a breakage in the boundary portion when processing the plate material by means of the movable die.

According to the press-die and method of the one or more embodiments of the invention, there is provided the movable die which can relatively move with respect to the upper die, and the upper die is moved downward together with the movable die. Thus, the first forming portion in the product is formed by the movable die and the second forming portion is formed between the upper die and the lower die. The upper die is continuously moved downward to press the peripheral edge portion of the plate material downward together with the holder. Therefore, a tensile force is always applied to the plate material.

Consequently, the plate material can reliably and easily reach a plastic region when the plate material is processed by the movable die and the upper die. As a result, it is possible to obtain a product of high quality without generating a crack or a wrinkle in the plate material to be press-worked.

Other aspects and advantages of the invention will be apparent from the following description, the drawings and the claims.

DETAILED DESCRIPTION OF THE EXEMPLARY EMBODIMENTS

An exemplary embodiment of a press-die according to the invention will be described below in detail with reference to the accompanying drawings.

Figure 1:
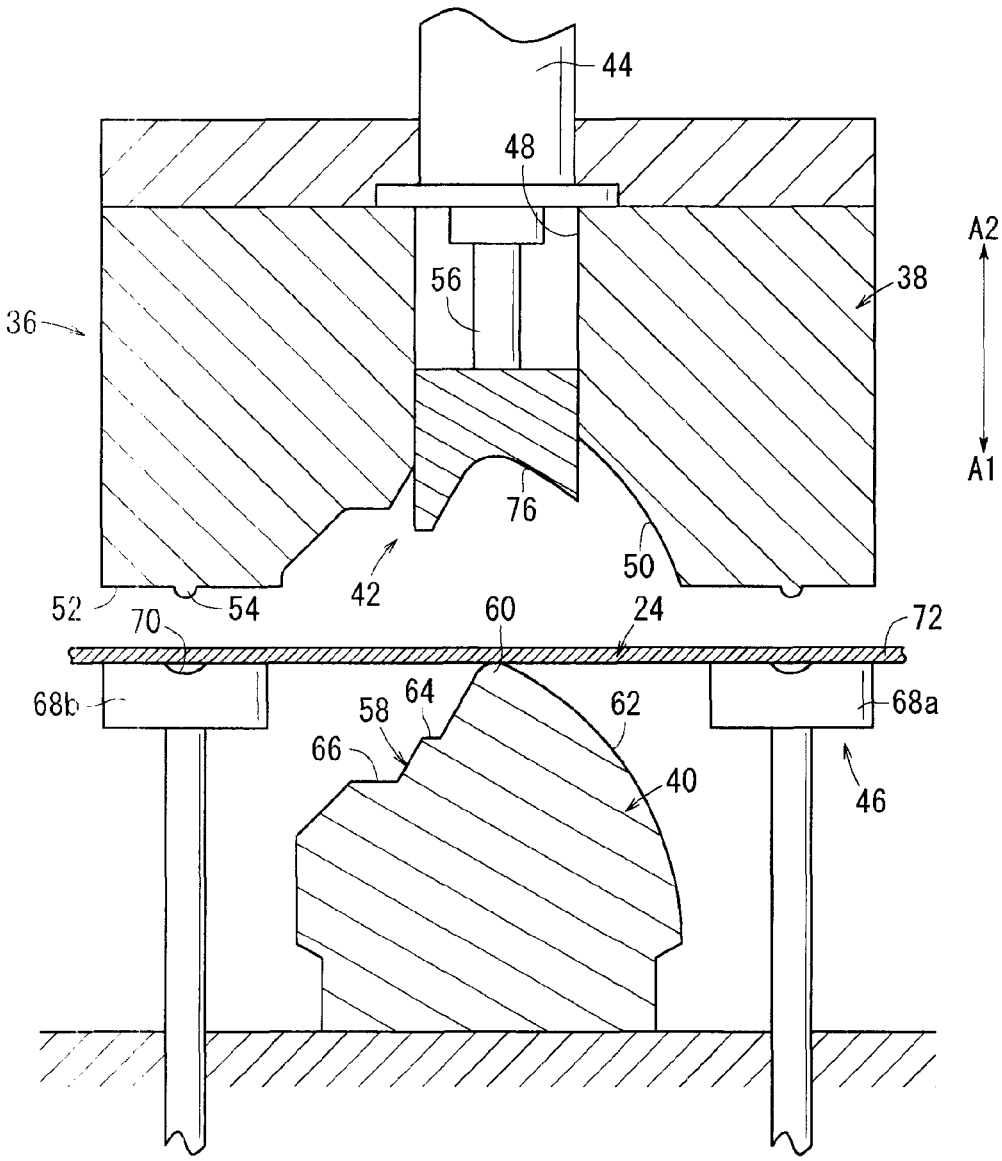
FIG. 1 is a longitudinal sectional view showing a preparing state of a press-working apparatus using a press-die according to an exemplary embodiment of the invention.
Figure 2:
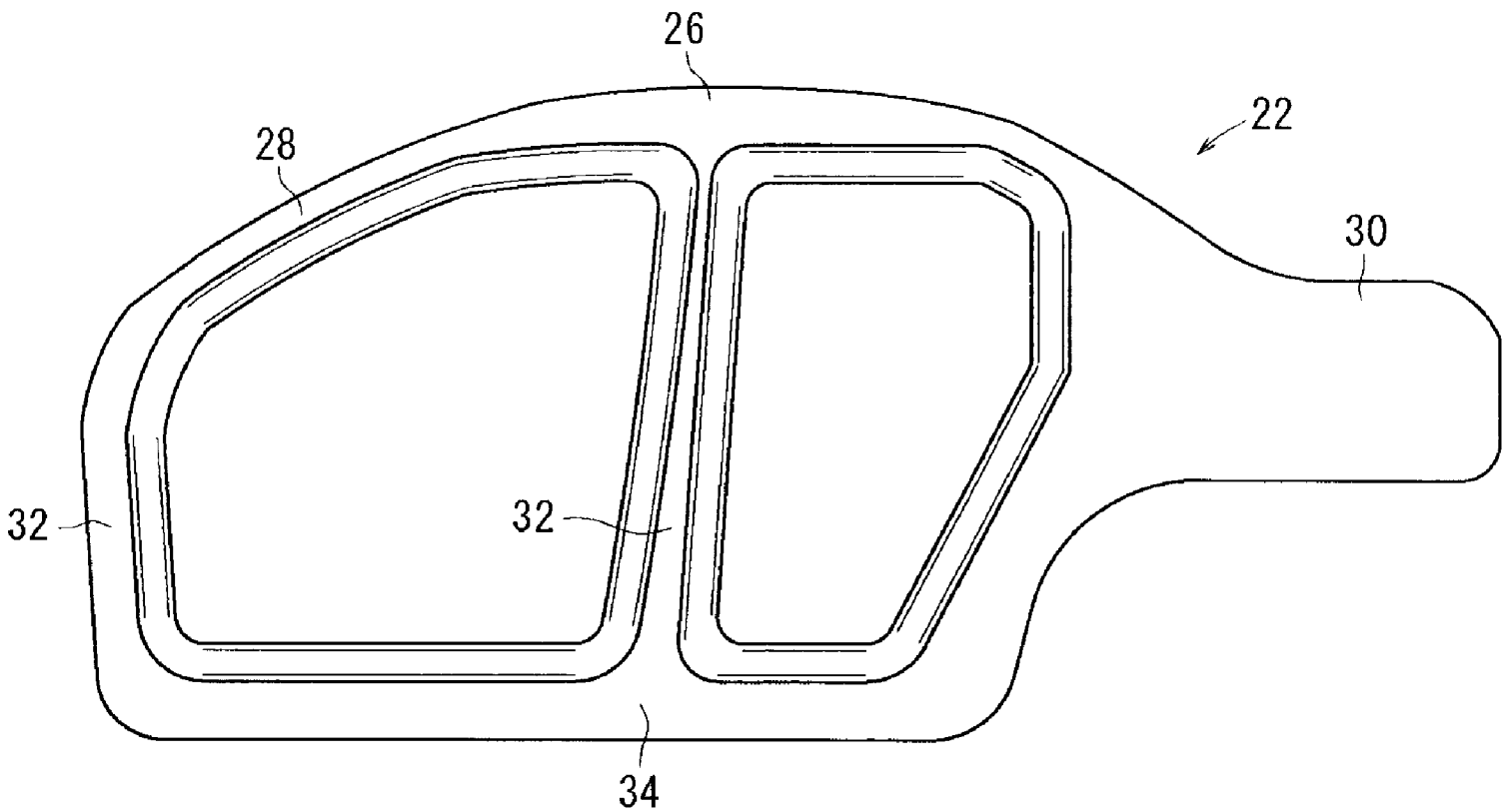
FIG. 2 is a schematic plan view showing a side outer panel as a product obtained by processing a steel plate through the press-working apparatus illustrated in FIG. 1.

In FIG. 1, the reference numeral 20 denotes a press-working apparatus using the press-die according to the exemplary embodiment of the invention. As shown in FIG. 2, description will be given to the case in which a side outer panel (a product) 22 constituting a side part of an automobile is press-worked from a steel plate (a plate material) 24 to be a blank material.

First of all, the side outer panel 22 which is press-worked by the press-working apparatus 20 will be briefly described with reference to FIG. 2.

The side outer panel 22 is constituted by a roof rail portion (a first forming portion) 26 used on both side surfaces in an automobile respectively, holding a side part of a roof and extended in an almost horizontal direction, a pillar portion 28 extended downward with respect to the roof rail portion 26, a rear quarter portion 30 having a rear fender in a rear part of the car, and an underframe portion 34 provided in almost parallel below the roof rail portion 26 and connected by a frame portion 32 coupled to the pillar portion 28.

The press-working apparatus 20 for press-working the side outer panel 22 includes a die portion 36 for press-working the steel plate 24 as shown in FIGS. 1 and 3 to 6. The die portion 36 includes an upper die 38, a lower die 40 opposed to the upper die 38 therebelow, a movable die 42 which is provided in the upper die 38 and can be relatively displaced with respect to the upper die 38, a control mechanism 44 attached onto the upper die 38 and serving to control a displacement in an axial direction of the movable die 42, and a holder portion 46 capable of holding the steel plate 24 when carrying out press-working by means of the upper die 38 and the lower die 40.

The upper die 38 is provided in an upper part of the press-working apparatus 20 and faces the lower die 40 and the steel plate 24 mounted on the lower die 40, and furthermore, is disposed to carry out a stroke displacement toward the lower die 40 side (a direction of an arrow A1) under a driving action of a driving portion which is not shown. In the upper die 38, an attaching portion 48 in which the movable die 42 is to be provided is formed in a central part, and a first forming surface 50 and an outer edge portion 52 are provided on an outside around the attaching portion 48. The first forming surface 50 serves to carry out press-working together with the lower die 40 in an abutment on the steel plate 24. The outer edge portion 52 is formed on a further outside of the first forming surface 50 and takes an almost planar shape. The first forming surface 50 is formed to be gradually dented upward (a direction of an arrow A2) from the outer edge portion 52 toward the central part of the upper die 38.

The movable die 42 is inserted into the attaching portion 48 and is provided to be displaceable in an axial direction (the directions of the arrows A1 and A2). In addition, the control mechanism 44 is provided on the attaching portion 48 together with the movable die 42.

The outer edge portion 52 is provided with a convex portion 54 which is protruded downward from a forming surface facing the steel plate 24. The convex portion 54 is formed to have an almost semicircular section, for example, and is protruded from the forming surface in a predetermined height and is formed circularly to surround the attaching portion 48.

The control mechanism 44 is formed by a gas spring filled with a gas, for example, and has a lower end to which the movable die 42 is coupled through a pin 56, and is provided to enable an energization over the movable die 42 toward the lower die 40 side (the direction of the arrow A1).

The lower die 40 is provided in a lower part of the press-working apparatus 20 and is disposed to face the movable die 42 and the first forming surface 50 of the upper die 38.

The lower die 40 has a second forming surface 58 taking such a sectional shape that a central part facing the movable die 42 is protruded like a peak in an upward direction. The steel plate 24 abuts on an upper surface of the second forming surface 58, and the movable die 42 and the upper die 38 are moved downward so that press-working is carried out over the second forming surface 58.

The second forming surface 58 includes a top portion 60 which is formed in an almost central part and is disposed in the closest position to the upper die 38, a curved portion 62 which is formed on a blank holder 68*a* side constituting the holder portion 46 and is extended downward from the top portion 60, and first and second step portions (portions having steps) 64 and 66 which are provided on a blank holder 68*b* side to be an opposite side to the curved portion 62 with respect to the top portion 60.

The top portion 60 has a tip formed to have a section taking a round shape and constitutes a part of the roof rail portion 26 of the side outer panel 22 when the steel plate 24 is processed. Moreover, the curved portion 62 is constituted by a gentle curved surface (an identical surface) to be outward convex.

The first step portion 64 is formed in a position placed obliquely and downward from the top portion 60 toward the blank holder 68*b* side and is protruded slightly in an almost horizontal direction. The second step portion 66 is formed in a position placed further obliquely and downward with respect to the first step portion 64 and is further protruded slightly in the almost horizontal direction.

The top portion 60 (the first forming portion), the first step portion 64 (the first forming portion) and a part of the curved portion 62 (the first forming portion) which constitute the second forming surface 58 perform a press-working of the steel plate 24 together with the movable die 42, and furthermore, the residual part (the second forming portion) in the curved portion 62 and the second step portion 66 (the second forming portion) carry out the press-working together with the upper die 38.

Moreover, the holder portion 46 capable of holding the steel plate 24 together with the upper die 38 is provided on the outside of the lower die 40. The holder portion 46 is provided opposite to the outer edge portion 52 of the upper die 38 and is constituted by a set of blank holders (holders) 68*a* and 68*b* provided to be displaceable toward the upper die 38 side (the direction of the arrow A2). In other words, the blank holders 68*a* and 68*b* are disposed on both sides around the lower die 40, respectively.

The blank holders 68*a* and 68*b* are formed to take a shape of a block and are provided to be upward displaceable by energizing means such as a spring or a cylinder. Forming surfaces to be upper surfaces of the blank holders 68*a* and 68*b* are formed almost horizontally in a planar shape, and a circular concave portion 70 is formed on the forming surface in a corresponding position to the convex portion 54 of the upper die 38. The concave portion 70 is formed to be dented in an almost semicircular section and a depth thereof is set corresponding to a height of the convex portion 54. In the press-working, the convex portion 54 of the upper die 38 is inserted into the concave portion 70.

When the upper die 38 is to be moved downward to press the steel plate 24, consequently, a peripheral edge portion 72 of the steel plate 24 is interposed and held between the blank holders 68*a* and 68*b* and the upper die 38, and the upper die 38 is moved downward while pressing the blank holders 68*a* and 68*b* downward so that the steel plate 24 is processed and a bead 74 having a semicircular section is thus formed.

The movable die 42 is provided in the upper die 38 through the attaching portion 48 and can be displaced separately from the upper die 38 by means of the control mechanism 44. In detail, the movable die 42 is attached to the upper die 38 through the control mechanism 44. Therefore, the movable die 42 is displaced in the axial direction (the directions of the arrows A1 and A2) together with the upper die 38 and can also be displaced separately from the upper die 38 by means of the control mechanism 44. The movable die 42 is energized toward the lower die 40 side (the direction of the arrow A1) by the control mechanism 44 and is protruded slightly downward with respect to the first forming surface 50 of the upper die 38.

Moreover, the movable die 42 is disposed opposite to the vicinity of the top portion 60 of the second forming surface 58 in the lower die 40 and has, in a lower part thereof, a third forming surface 76 to carry out the press-working together with the lower die 40.

The third forming surface 76 is formed to be upward dented in a corresponding shape to sectional shapes of the top portion 60, the first step portion 64 and a part of the curved portion 62 (the first forming portion) in the second forming surface 58 of the lower die 40, and furthermore, a sectional shape corresponds to the roof rail portion 26 of the side outer panel 22 which is press-worked from the steel plate 24, for example.

The press-working apparatus 20 using the press-die according to the embodiment of the invention basically has the structure described above, and an operation, a function and an advantage thereof will be described with reference to FIGS. 1 and 3 to 6.

First of all, as shown in FIG. 1, a state in which the upper die 38 is retreated upward in the press-working apparatus 20 together with the movable die 42 by means of a driving portion which is not shown is set to be an initial position. In the initial state, the steel plate 24 to be a blank material is mounted on the lower die 40 and the blank holders 68*a* and 68*b* to bring a preparing state in which the press-working can be carried out. In this case, the movable die 42 is energized by the control mechanism 44 so that it is disposed in a slightly downward protruding position with respect to the first forming surface 50 of the upper die 38.

Figure 3:
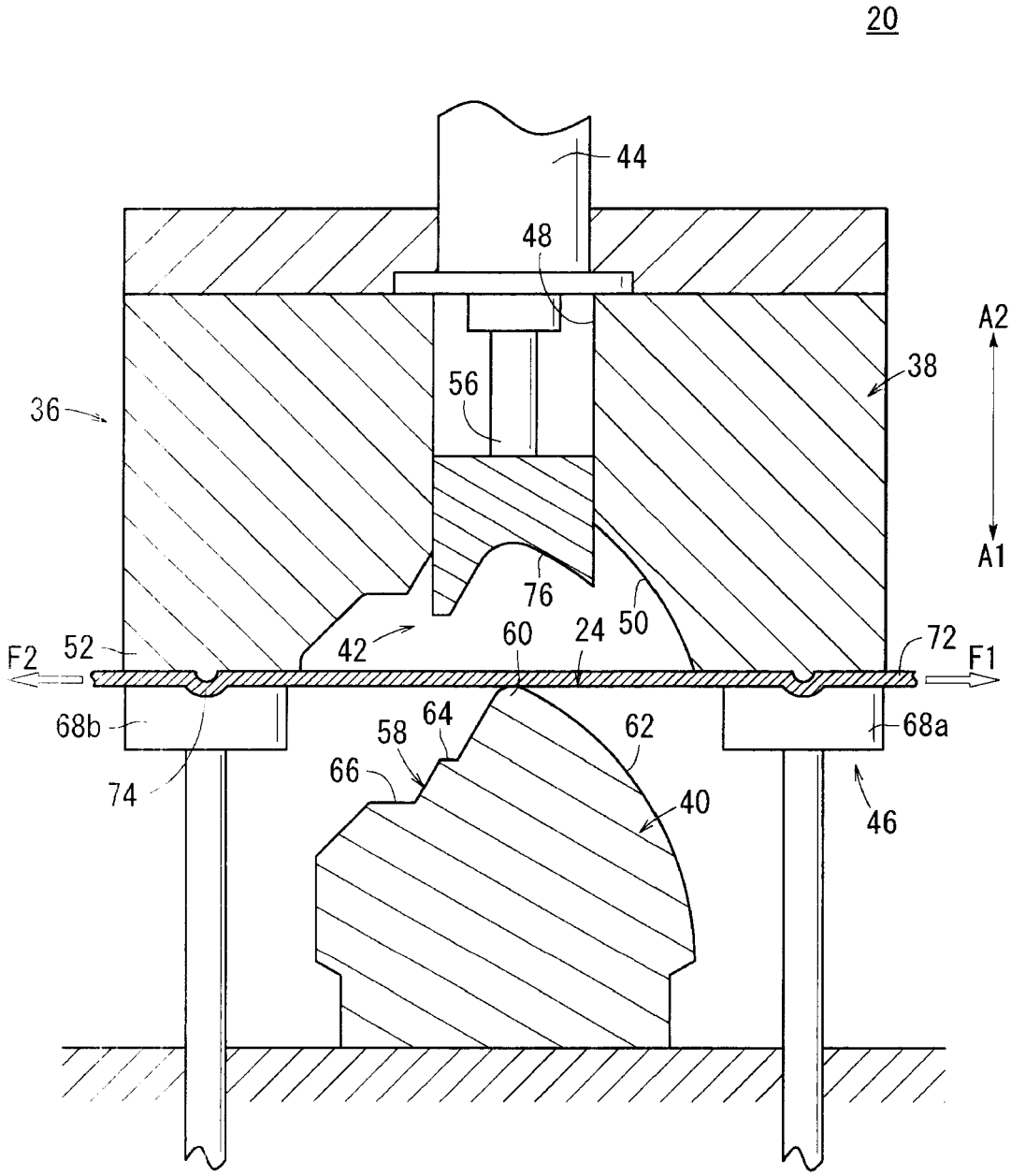
FIG. 3 is a longitudinal sectional view showing a state in which an upper die is moved downward to press a blank holder downward and to hold an outer edge portion of the steel plate at the same time in the press-working apparatus of FIG. 1.

In the preparing state, next, the upper die 38 and the movable die 42 are moved downward under a driving action of the driving portion which is not shown and the outer edge portion 52 of the upper die 38 is caused to abut on the upper surface of the steel plate 24 above the blank holders 68*a* and 68*b* as shown in FIG. 3. Then, the upper die 38 is further moved downward to interpose the peripheral edge portion 72 of the steel plate 24 between the outer edge portion 52 and the blank holders 68*a* and 68*b*, and furthermore, the upper die 38 presses down the blank holders 68*a* and 68*b* through the steel plate 24. Thus, the convex portion 54 is pushed into the concave portion 70 of each of the blank holders 68*a* and 68*b* together with the steel plate 24 by a pressing force of the upper die 38 so that the bead 74 having a semicircular section is formed on the peripheral edge portion 72 of the steel plate 24.

Consequently, the steel plate 24 is positioned between the upper die 38 and the blank holders 68*a* and 68*b* through the bead 74. Thus, the steel plate 24 is regulated to be moved in a horizontal direction which is orthogonal to the displacing direction of the upper die 38 in the processing operation, and furthermore, tensile forces F1 and F2 (see FIG. 3) can be applied to the steel plate 24. The tensile forces F1 and F2 are applied in such a direction as to separate the peripheral edge portions of the steel plate 24 which are held by the blank holders 68*a* and 68*b* respectively from each other, for example.

In detail, for example, the tensile forces F1 and F2 are applied obliquely and downward with the top portion 60 set to be an apex in the vicinity of the top portion 60 in the lower die 40, respectively.

In this case, the movable die 42 and the first forming surface 50 of the upper die 38 do not abut on the steel plate 24 respectively, and the steel plate 24 has not been processed by the first forming surface 50 and the third forming surface 76 of the movable die 42.

Figure 4:
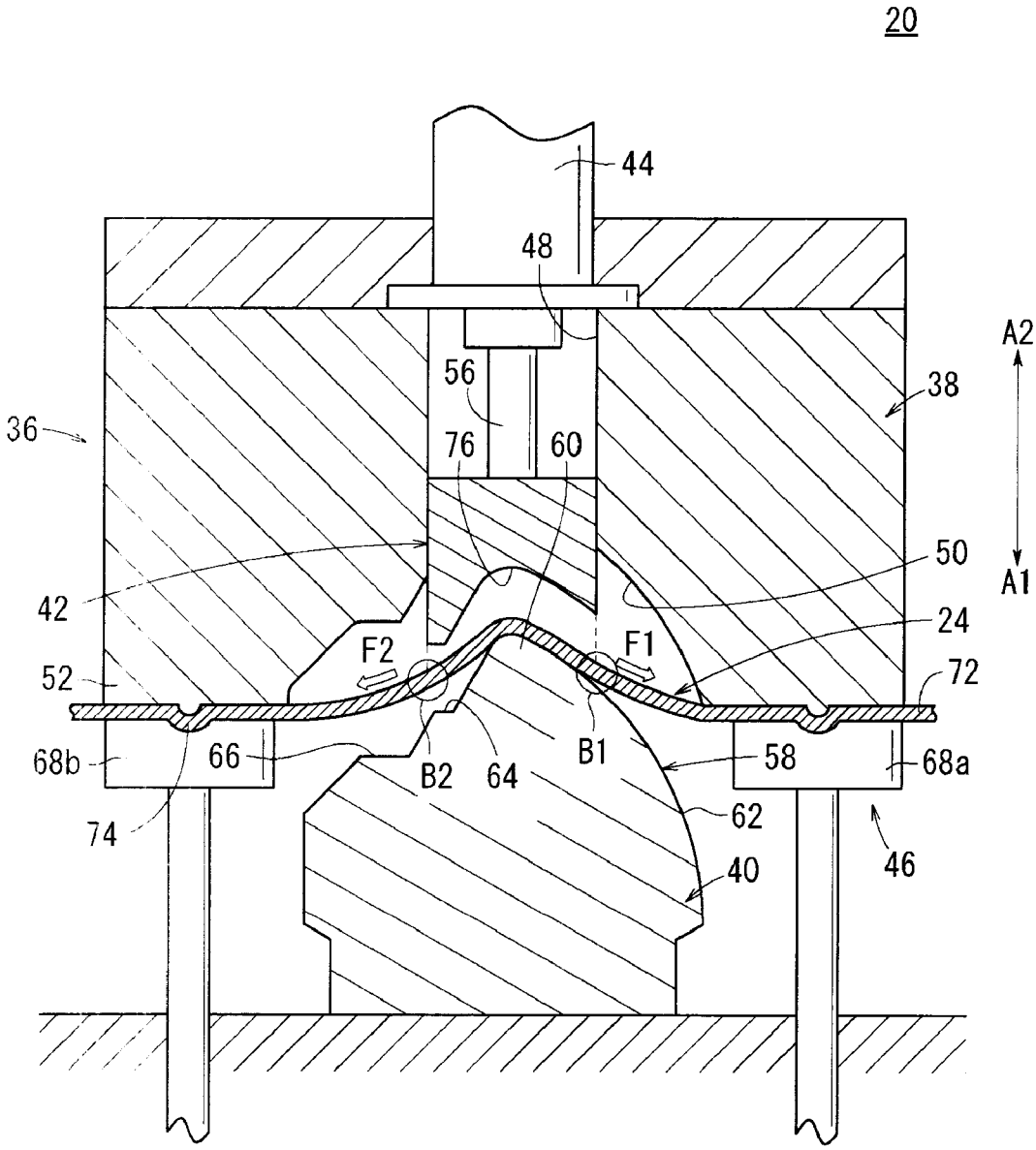
FIG. 4 is a longitudinal sectional view showing a state in which the outer edge portion of the steel plate held on the upper die and the blank holder is moved downward with the downward movement of the upper die and a central part thereof abuts on a second forming portion of a lower die in the press-working apparatus of FIG. 3.
Figure 5:
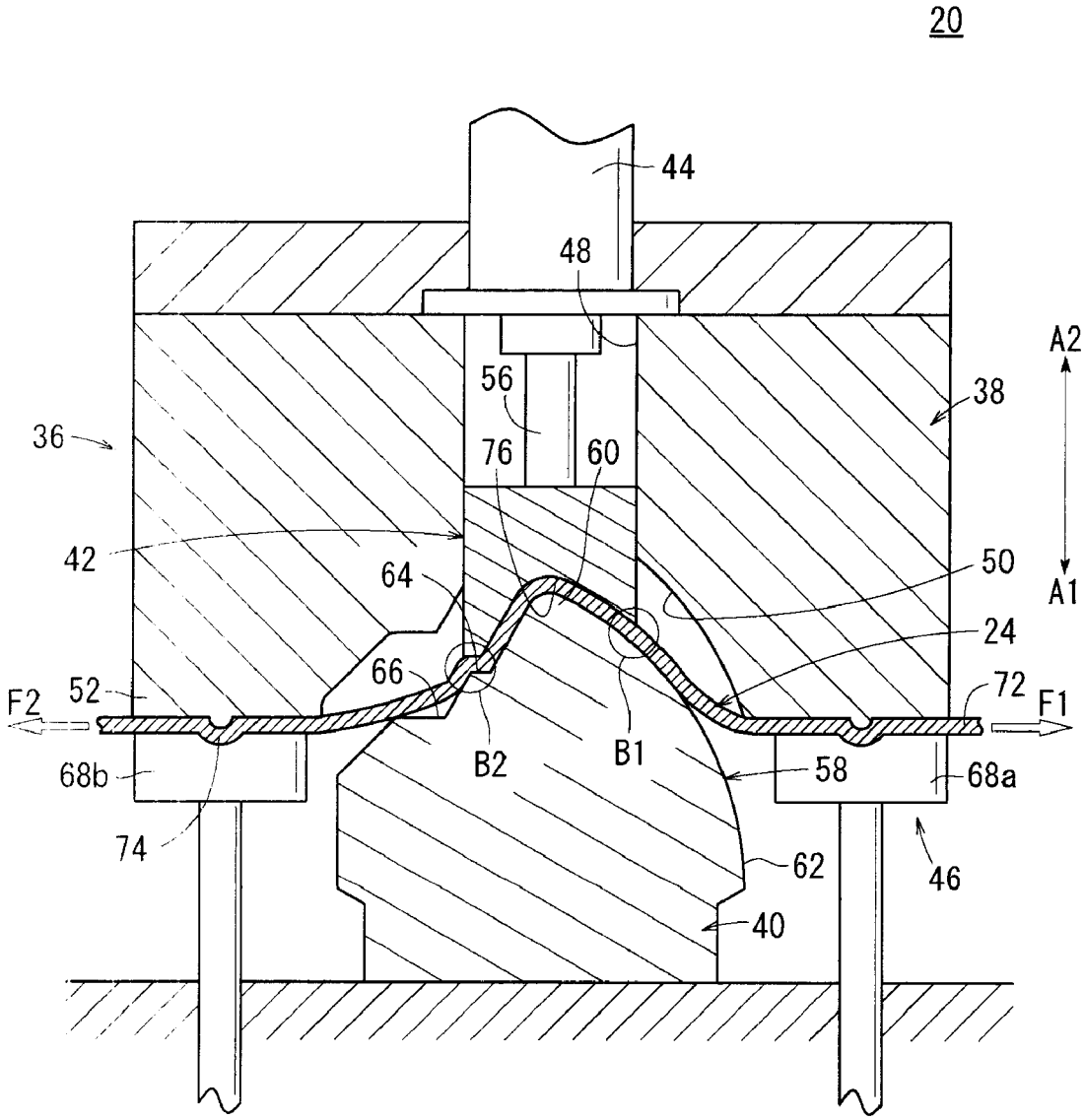
FIG. 5 is a longitudinal sectional view showing a state in which the upper die is further moved downward so that only a movable die abuts on the steel plate to carry out press-working together with the lower die in the press-working apparatus of FIG. 4.

As shown in FIG. 4, furthermore, the upper die 38 is moved downward so that the blank holders 68*a* and 68*b* are pressed downward against an energizing force of energizing means together with the peripheral edge portion 72 of the steel plate 24, and the steel plate 24 is gradually deformed and curved to conform to the upper surface of the second forming surface 58 around the top portion 60 of the lower die 40. As shown in FIG. 5, then, the upper die 38 is further moved downward so that the third forming surface 76 of the movable die 42 abuts on the steel plate 24 and the press-working is carried out together with the second forming surface 58 of the lower die 40. Consequently, the roof rail portion 26 having a stepped section which is constituted by a comparatively small bent round part is press-worked by the movable die 42. In this case, the steel plate 24 has not been processed by the first forming surface 50 of the upper die 38 at an outside of the portion processed by the movable die 42.

When the processing is being carried out by the movable die 42, moreover, the upper die 38 and the blank holders 68*a* and 68*b* are continuously moved downward under the driving action of the driving portion (not shown). After the movable die 42 abuts on the steel plate 24 to carry out the processing together with the lower die 40, the movable die 42 is gradually moved upward with respect to the upper die 38 so as to be accommodated in the attaching portion 48 against an energizing force of control means because the downward displacement is regulated by the lower die 40 and the steel plate 24.

Figure 6:
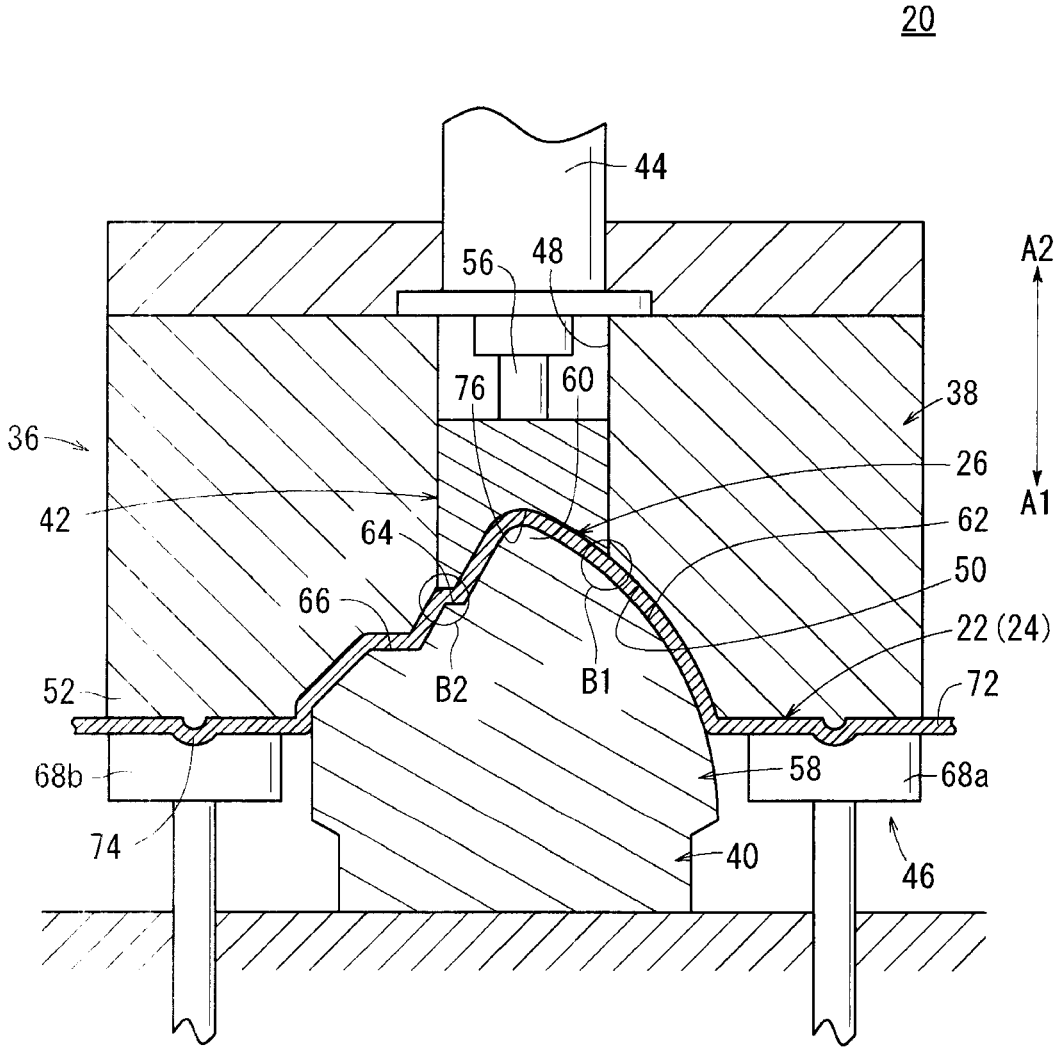
FIG. 6 is a longitudinal sectional view showing a state in which the upper die is further moved downward with the processing operation completed by the movable die in FIG. 5, and a residual part in the steel plate is processed together with the lower die and a product is obtained from the steel plate.
Figure 7A:
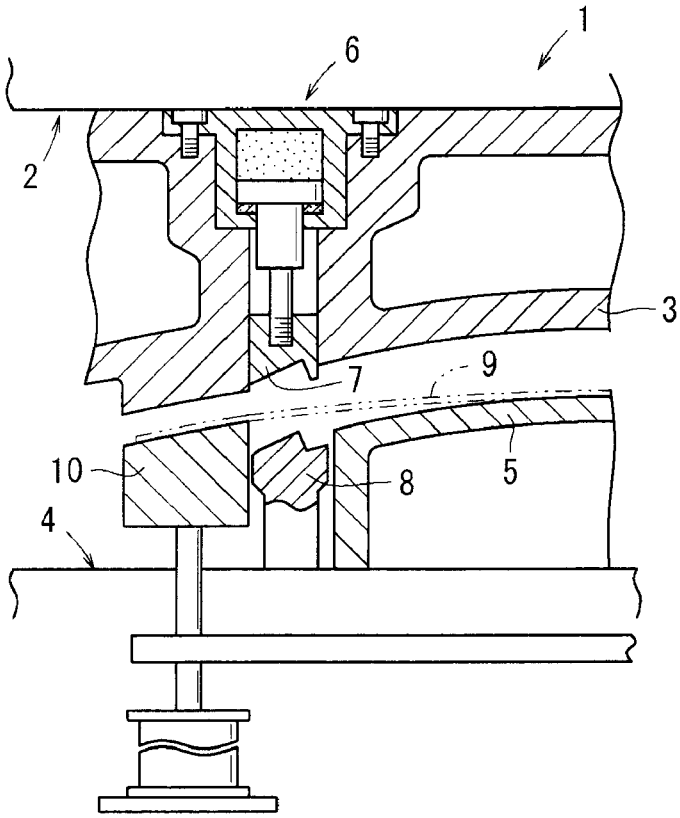
FIG. 7A is a sectional view showing a preparing state of a press-working apparatus according to the conventional art.
Figure 7B:
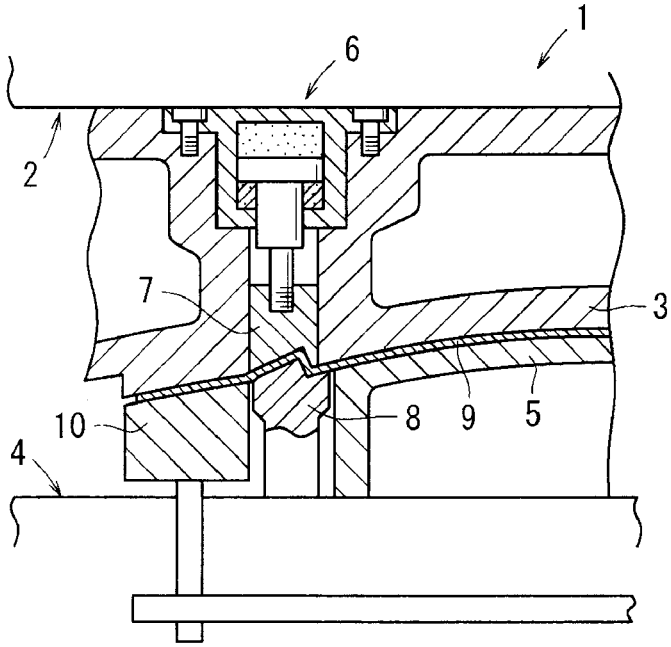
FIG. 7B is a sectional view showing a completing state in which an upper die is moved downward in the state of FIG. 7A.

As shown in FIG. 6, finally, the upper die 38 is further moved downward so that the first forming surface 50 abuts on the upper surface of the steel plate 24 which is previously deformed along the second forming surface 58 of the lower die 40. Thus, the steel plate 24 is deformed to be upward convex by the first and second forming surfaces 50 and 58 and the steel plate 24 in a part provided on the outside of the movable die 42 is subjected to a plastic deformation and is thus press-worked to have a desirable shape. Consequently, the side outer panel 22 constituting a body of an automobile is formed by the press-working. In this case, the movable die 42 is pushed upward by a predetermined distance against the energizing force of the control mechanism 44 with the third forming surface 76 press-working the steel plate 24 together with the lower die 40.

The upper die 38 including the movable die 42 is moved upward in such a direction as to separate from the lower die 40 (the direction of the arrow A2) under the driving action of the driving portion which is not shown. Then, a press-product subjected to the press-working is taken out of the die portion 36.

As described above, in the embodiment, there is employed the structure in which the upper die 38 constituting the die portion 36 is provided with the movable die 42 and the movable die 42 can be displaced independently. The steel plate 24 is press-worked by the movable die 42 to form the roof rail portion 26 of the side outer panel 22 to be a product, for example. Then, the upper die 38 is further moved downward to form the residual part of the steel plate 24 between the upper die 38 and the lower die 40. Thus, the side outer panel 22 to be the product is obtained.

For example, consequently, the part taking the small bent round shape in the product is formed previously by the movable die 42, and the upper die 38 holding the outer edge portion 52 of the steel plate 24 and the blank holders 68*a* and 68*b* are continuously moved downward in the processing carried out by the movable die 42. Thus, it is possible to perform the press-working while always applying the tensile forces F1 and F2 to the steel plate 24. Consequently, it is possible to obtain a product of high quality without generating a crack or a wrinkle in the steel plate 24.

Moreover, the upper die 38 is continuously moved downward including the operation for processing the steel plate 24 through the movable die 42. Therefore, the tensile forces F1 and F2 are always applied to the steel plate 24. When the steel plate 24 is to be processed by the movable die 42 and the upper die 38, consequently, it is possible to reach a plastic region reliably and easily. As a result, it is possible to form the steel plate 24 through a plastic deformation into a desirable shape without generating the crack or the wrinkle therein.

Before the steel plate 24 is press-worked by the movable die 42 and the upper die 38, furthermore, the upper die 38 is moved downward together with the blank holders 68*a* and 68*b* and the steel plate 24 is caused to previously abut on the top portion 60 of the lower die 40. Consequently, it is possible to previously deform the steel plate 24 along the upper surface (the curved portion 62) of the lower die 40 which is protruded upward. Also in the case in which the movable die 42 and the upper die 38 are caused to abut on the steel plate 24 thus deformed and the press-working is carried out together with the lower die 40, it is possible to avoid an occurrence of a boundary line breakage) in boundary portions B1 and B2 (boundary portions) between the movable die 42 and the upper die 38. As a result, it is possible to avoid a deterioration in quality due to the occurrence of the breakage in the product.

Consequently, it is possible to obtain a product of high quality.

In detail, the boundary portion B2 between the movable die 42 and the upper die 38 at the blank holder 68*b* side takes an identical shape to the shape of the second step portion 66 provided in the lower die 40. Therefore, there is no fear that the boundary line (breakage) might occur.

While description has been made in connection with specific exemplary embodiment of the invention, it will be obvious to those skilled in the art that the press-die and the press-working method according to the invention are not restricted to the embodiment and various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

20 press-working apparatus
22 side outer panel
24 steel plate
26 roof rail portion
36 die portion
38 upper die
40 lower die
42 movable die

46 holder portion
48 attaching surface
50 first forming surface
58 second forming surface
68*a*, 68*b* blank holder
70 concave portion
76 third forming surface

What is claimed is:

1. A press-die used in a press-working apparatus for forming a product through an application of a pressurizing force to a plate material, the press-die comprising:

an upper die configured to move in an axial direction under a driving action of a driving portion of the press-working apparatus;

a movable die provided within the upper die and configured to relatively move with respect to the upper die;

a lower die provided in an opposite position to the upper die and the movable die; and a holder provided in a side part of the lower die to face the upper die, configured to hold a peripheral edge portion of the plate material together with the upper die, and also configured to move in the axial direction under a pressing action through the upper die, wherein the upper die and the movable die are configured to move downward together so that a first forming portion in the product is formed from the plate material by the movable die and the lower die and a second forming portion in the product is formed by the upper die and the lower die, and wherein the upper die and the holder are configured to continuously move downward together when the first forming portion is formed by the movable die.

2. A press-working method for forming a press-product by applying a pressurizing force to a plate material by means of a press-die of a press-working apparatus, the method comprising:

moving an upper die downward in an axial direction under a driving action of a driving portion of the press-working apparatus;

holding a peripheral edge portion of the plate material between the upper die and a holder facing the upper die, and moving the peripheral edge portion downward together with the holder;

causing the plate material to abut on a lower die, thereby carrying out pre-forming;

press-working a part of the plate material by a movable die which moves with the upper die; and further moving the upper die toward the lower die side, thereby press-working an unformed part in the plate material by the upper die and the lower die, wherein the upper die and the holder are continuously moved downward during said press-working by the movable die.

3. The method according to claim 2, further comprising:

causing a boundary portion of the plate material which corresponds to a boundary between the movable die and the upper die and a vicinity of the boundary portion facing the movable die and the upper die to abut on the lower die, before said press-working by the movable die.

* * * * *